US006004627A

United States Patent [19]

Duffy et al.

[11] Patent Number: 6,004,627

[45] Date of Patent: Dec. 21, 1999

[54] METHOD AND APPARATUS FOR APPLYING A COATING TO THE HEAD/SHANK JUNCTION OF EXTERNALLY THREADED ARTICLES

[75] Inventors: Richard Duffy, Shelby Township; Eugene Sessa, Mt. Clemens, both of Mich.

[73] Assignee: Nylok Fastener Corporation, MaComb, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,684

[22] Filed: Jan. 7, 1997

[51] Int. Cl.[6] ..... B05D 1/02; B05D 3/02; B05B 13/02

[52] U.S. Cl. ..... 427/425; 427/10; 427/314; 427/256; 427/345; 427/388.1; 427/375; 118/699; 118/700; 118/319; 118/320

[58] Field of Search ..... 427/10, 197, 180, 427/256, 314, 375, 388.1, 421, 425, 385.5, 345, 318; 118/696, 697, 699, 700, 308, 310, 319, 320; 411/399, 369, 542, 258, 82

[56] References Cited

U.S. PATENT DOCUMENTS

| | | | |
|---|---|---|---|
| 3,416,492 | 12/1968 | Greenleaf | 118/320 |
| 3,760,928 | 9/1973 | Galitz | 198/19 |
| 4,060,868 | 12/1977 | Axvig et al. | 10/72 R |
| 4,309,787 | 1/1982 | Lapohn | 10/155 A |
| 4,775,555 | 10/1988 | Duffy | 427/183 |
| 4,820,235 | 4/1989 | Weber et al. | 411/188 |
| 4,842,890 | 6/1989 | Sessa et al. | 427/47 |
| 5,078,083 | 1/1992 | DiMaio . | |
| 5,090,355 | 2/1992 | DiMaio . | |
| 5,148,378 | 9/1992 | Shibayama et al. | 364/571.07 |
| 5,244,326 | 9/1993 | Henriksen | 411/366 |
| 5,262,197 | 11/1993 | Pollizzi | 427/195 |
| 5,403,524 | 4/1995 | DiMaio et al. | 427/421 |
| 5,537,925 | 7/1996 | Secor et al. | 101/424.1 |

*Primary Examiner*—Shrive Beck
*Assistant Examiner*—Michael Barr
*Attorney, Agent, or Firm*—Niro, Scavone, Haller & Niro

[57] ABSTRACT

An apparatus for applying a coating to the head-shank junction of externally threaded fasteners in an automated fashion. The fasteners are positioned, head down, on rotating part holders positioned about the periphery of a rotating disc. The part holders may be magnetic or other forms, and are adapted to maintain the fasteners in a generally fixed position during their movement. The fasteners are pre-heated at a heating station during their rotational movement on the disc. A dispenser is then used to apply the coating to the articles, in timed sequence to the movement of the articles. In this fashion, a coating can be applied to selected portions of the entire periphery of the head-shank junction. A method for applying a coating to the head-shank junction of externally threaded fasteners in an automated fashion also forms part of the present invention.

18 Claims, 9 Drawing Sheets

METHOD AND APPARATUS FOR APPLYING A COATING TO THE HEAD/SHANK JUNCTION OF EXTERNALLY THREADED ARTICLES

BACKGROUND OF THE INVENTION

This invention generally relates to an apparatus and method for coating articles. More specifically, the invention provides either a liquid or melted powder coating to the head/shank junction of externally threaded fasteners.

There are many fastener applications that require a coating, such as a sealant coating, to be applied over the head/shank junction of male fasteners. For example, externally threaded fastener 12 shown in FIG. 6 includes head 13 and shank 18, and knurls 16 at the head/shank junction which extend generally normal to threads 17 on shank 18. Knurls 16 can then be coated with a suitable coating 19, as shown in FIG. 7, and coated fastener 12 can be put to a variety of uses. As one example, coated fastener 12 can then be pressed into an aperture within a stamping, to provide a mechanical lock within the stamping using coated knurls 16.

Various apparatus and methods are known for applying coatings to fasteners. For example, U.S. Pat. No. 4,842,890 discloses a powder spray apparatus which employs oppositely-directed belts to rotate the fasteners during spraying, while U.S. Pat. No. 4,775,555 patent describes relatively accurate spraying of internally threaded fasteners to provide a self-locking patch. U.S. Pat. Nos. 5,078,083 and 5,090,355 disclose rotating magnetic means for holding and rotating fasteners during spraying. However, the prior art fails to teach the application of a closely defined and substantially uniform coating to a specific location on an externally threaded fastener, such as the head-shank junction, for predetermined, intermittent time periods, with the coating application being responsive to fastener movement.

SUMMARY OF THE INVENTION

The present invention preserves the advantages of known apparatus and methods for coating threaded fasteners. In addition, it provides new advantages not available with known apparatus and methods for coating threaded fasteners, and overcomes associated disadvantages.

The invention is generally directed to an apparatus for applying a coating to externally threaded articles having a head and a shank. The coating is applied to the junction of the head and the shank in an automated fashion. The apparatus includes a moving support, such as a rotating disc or a conveyor belt, for conveying the articles, and a plurality of part holders adapted to support and to hold the articles in a generally fixed position during article movement with the support. Each part holder is capable of separately rotating each article generally about the part holder axis. A heating station is also provided, and is positioned adjacent the moving support and adapted to heat the articles to within a predetermined temperature range as the articles move with the support. Sensors, such as photoelectric sensors or proximity switches, are also used to sense the position of the heated articles as they move with the support. The apparatus also includes at least one dispenser, such as a hypodermic-type tube with a relatively narrow hollow tube, for intermittently applying a predetermined amount of the coating onto substantially only the head-shank junction of each article as the part holders and associated articles move with the support and simultaneous with their rotation. The coating application occurs in timed sequence with and is selectively responsive to the support-induced movement and simultaneous rotation of the articles.

In various embodiments the part holders can be cup-shaped or hold the articles by vacuum suction. In the particularly preferred embodiment, the part holders have a magnetic attraction for the articles. The part holders may include a timing sprocket engageable with a rotation mechanism and a variable speed motor for selectively controlling the speed of rotation of the part holders.

If a powder dispensing system is used, multiple spray nozzles communicated with a flow divider can be employed.

In a particularly preferred embodiment, a centering disc capable of rotation is positioned adjacent the moving support. The centering disc is adapted to contact the moving articles and thereby generally center each article on its associated part holder. This serves to minimize article movement relative to the associated part holder, and facilitate the application of a substantially uniform coating onto the article at the head-shank junction. In a preferred embodiment, the moving support is a rotating disc, and the rotating and centering discs rotate about their respective centers in opposite directions when viewed from a point located above the discs.

Preferably, the heating station includes induction coils positioned adjacent the edge of moving support. The induction are shaped and located to permit the adjacent passage of the articles, while heating the articles to the predetermined temperature range.

Fasteners coated with a liquid sealant can be dried, preferably using an infra-red forced-air oven to baking the coated articles.

An automated process for applying a coating to the head-shank junction of an externally threaded article also forms a part of the present invention. The process involves the steps of locating the articles on a moving support, preferably head-down, and rotating each article, preferably using part holders each adapted to support and to hold an article in a generally fixed position during article movement with the support, and capable of separately rotating each article generally about the part holder axis. The articles are continuously conveyed through a heating station using the moving support, where the articles are heated to within a predetermined temperature range. The position of the heated articles is sensed as the articles move with the support. Then, each article is separately rotated generally about its axis using the part holders. Now, a coating, such as a sealant, is automatically dispensed, in an intermittent fashion and in a predetermined amount, onto the head-shank junction of the articles as the part holders and associated articles move along the support and simultaneous with their rotation. The dispensing occurs in timed sequence with and is selectively responsive to the movement of the articles with the support and their simultaneous rotation. By controlling the speed and extent of article rotation, a coating can be applied to a 360° peripheral portion of each article, or any desired lesser peripheral portion. Using the invention, the coating application can be tightly controlled, so that only the head-shank junction of each article is coated, and not other portions of the article. Finally, with liquid coatings, the coated articles are baked for a time period sufficient to cause the liquid-based coating to dry and adhere to the fastener surface at the head-shank junction.

The automated process also preferably includes the step of centering each article on its associated holder to facilitate the application of a substantially uniform coating on the fastener surface at the head-shank junction. Vacuum means can also be used to collect powder overspray. The coated fasteners can be discharged from the moving support and the part holders by camming them off with the help of low-pressure air.

Using the apparatus and process of the present invention, powder-based or liquid-based sealant coatings can be applied. With powder-based coatings, the predetermined temperature range should be sufficient to melt the sealant coating and fuse it to the fastener surface at the head-shank junction. For the liquid-based PRECOTE® sealant, the predetermined temperature range is about 150° F., whereas for the NYSEAL® sealant, substantially higher temperature ranges are used.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DESCRIPTION OF THE PREFERRED EMBODIMENTS

Figure 1:
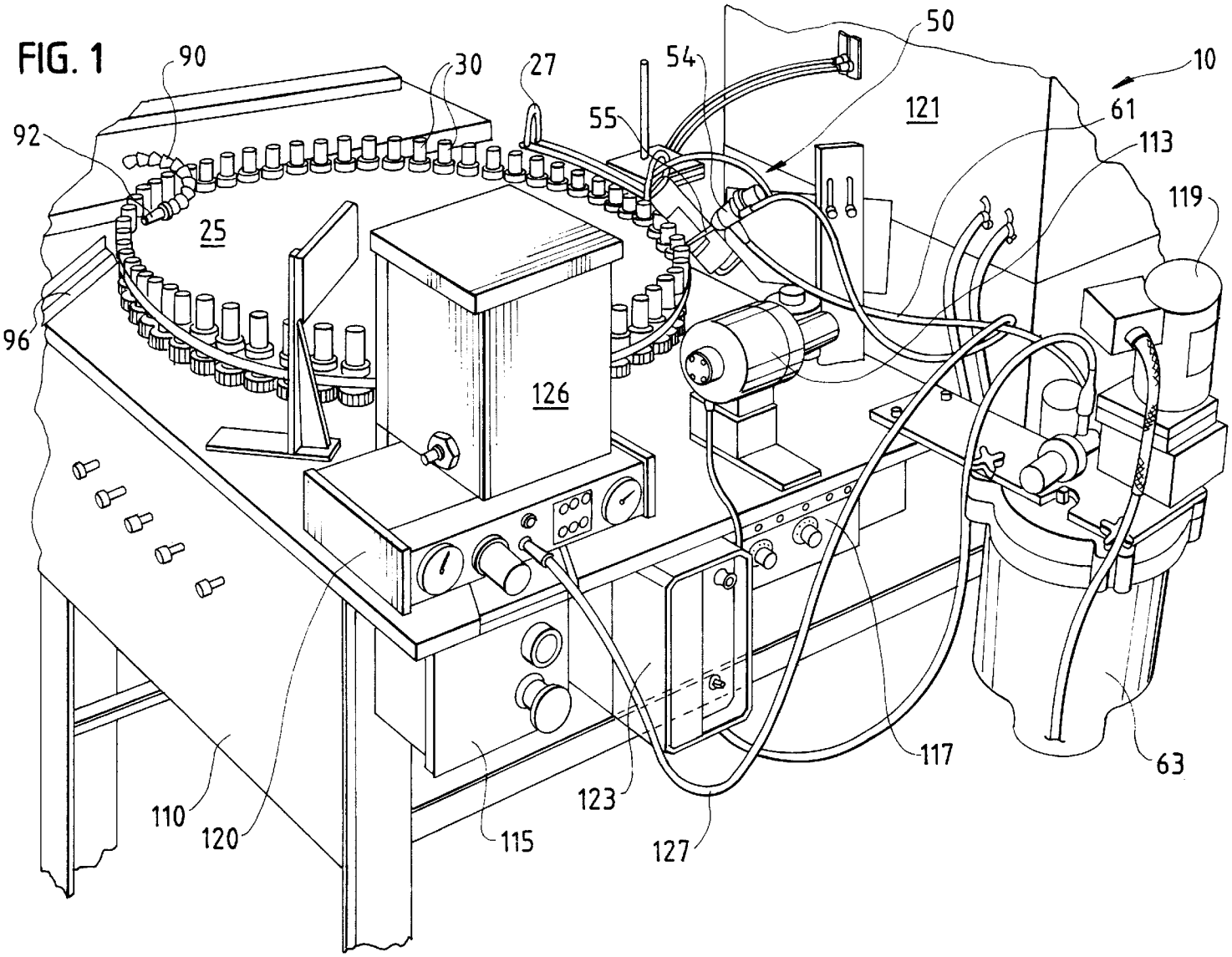
FIG. 1 is a right front oblique view of the apparatus of the present invention.
Figure 2:
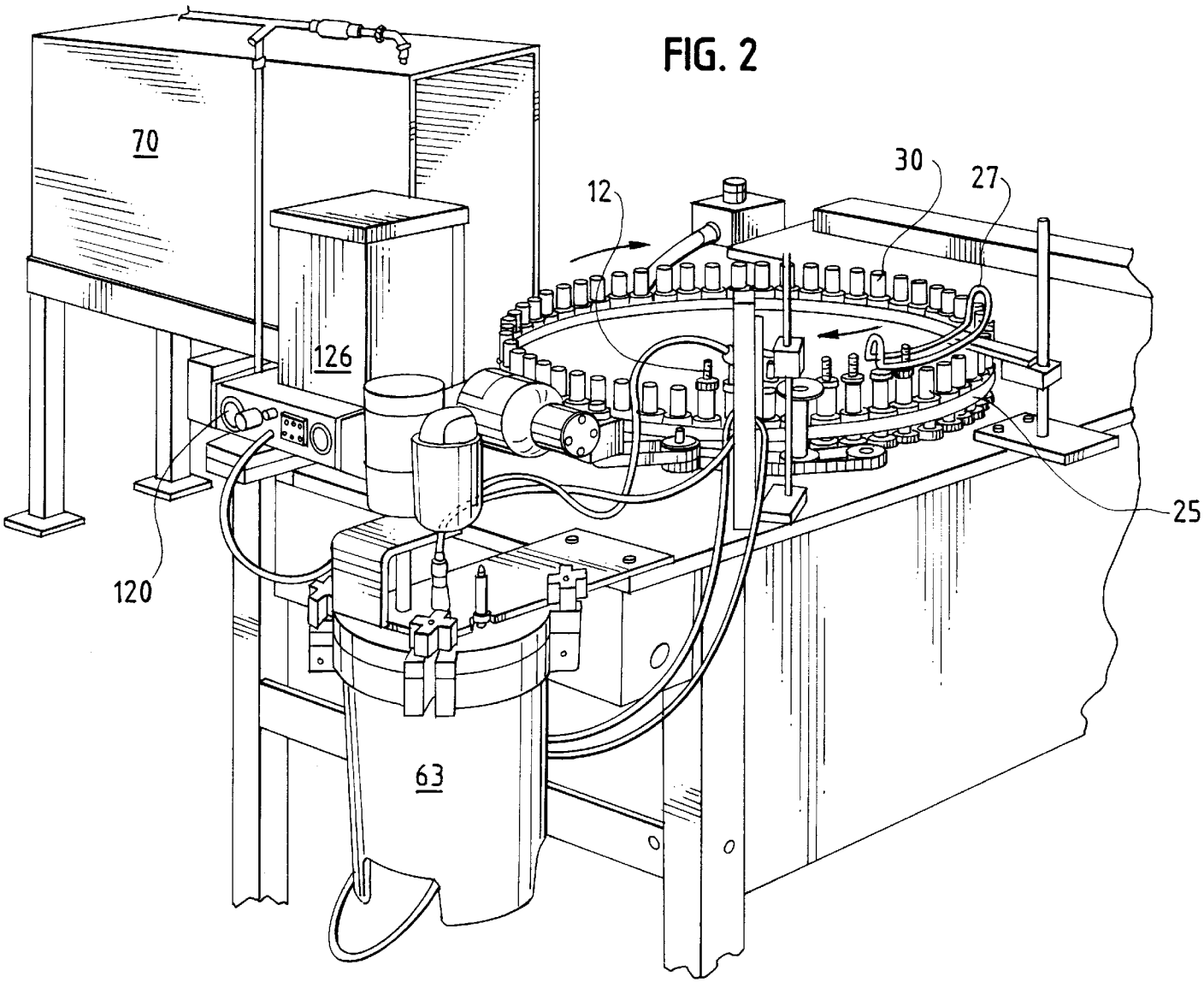
FIG. 2 is a right rear oblique view of the same apparatus shown in FIG. 1.
Figure 3:
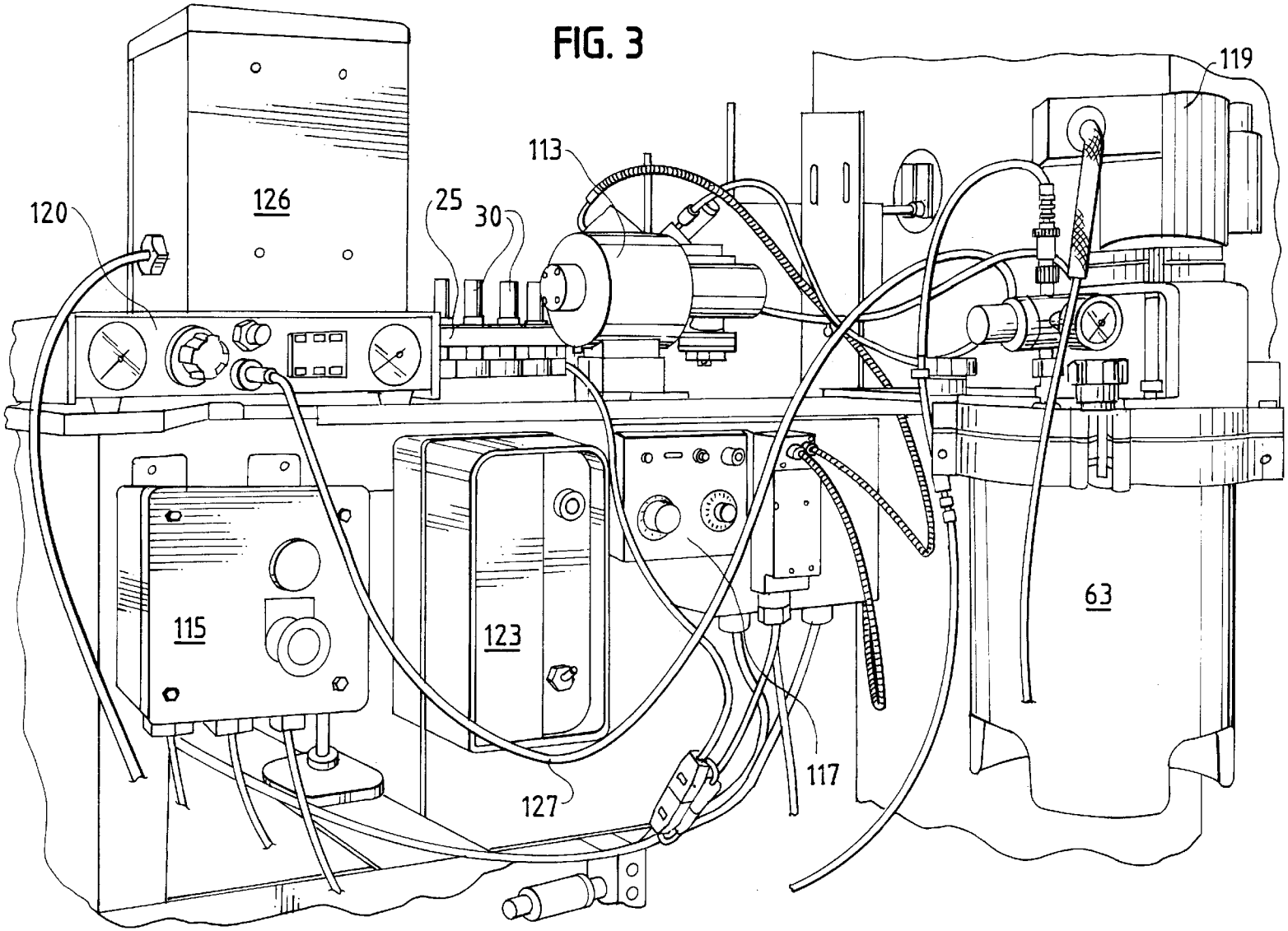
FIG. 3 is a side view of the controls associated with the apparatus of the present invention.

Referring now to FIG. 1, an apparatus according to the present invention, generally designated with the reference numeral 10, is shown. Apparatus 10 is designed to apply a coating to the head-shank junction of externally threaded fasteners 12, in an automated fashion.

Figure 5:
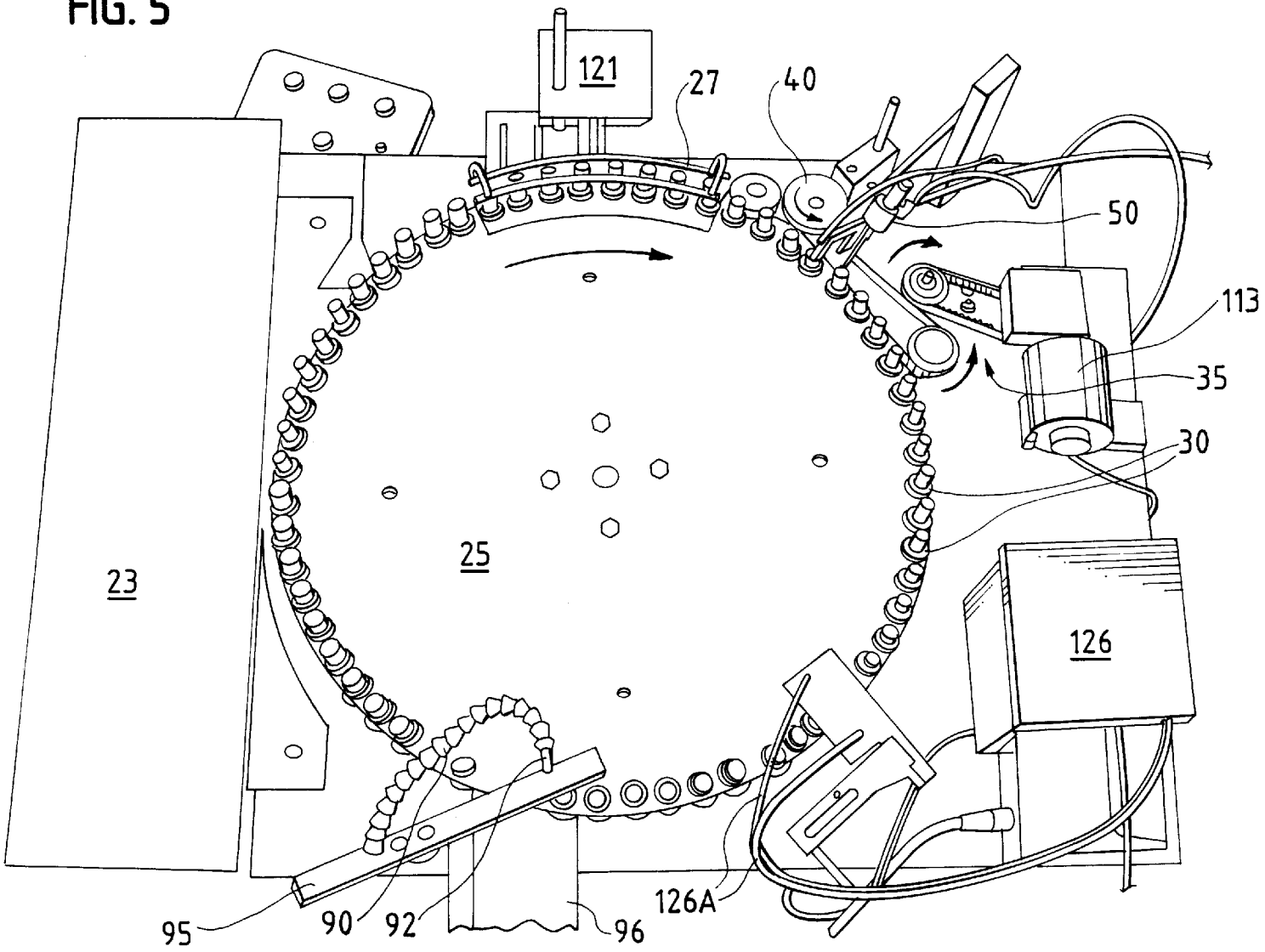
FIG. 5 is a top view of the apparatus.
Figure 6:
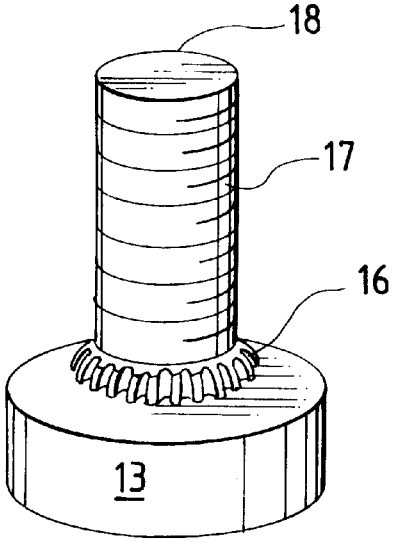
FIG. 6 is a perspective view of an externally threaded fastener.
Figure 7:
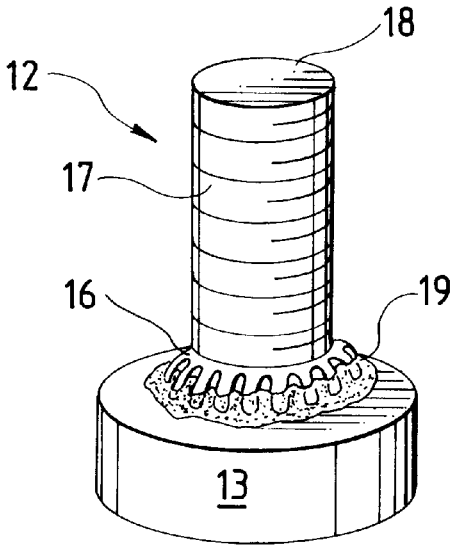
FIG. 7 is a view similar to FIG. 6, showing a coating applied over threads at the head-shank portion fastener, using the apparatus and method of the present invention.

Referring now to FIG. 1 and 5, in the preferred embodiment, fasteners 12 are arranged head down on part supply tray 23 or, alternatively, a feeder bowl (not shown), and automatically supplied to support disc 25 in any manner of ways well known to those of ordinary skill in the art. Support disc 25 rotates in a horizontal plane in the direction of the arrow. Alternatively, the fasteners can be sequentially supplied, head down, to a straight-line conveying system, such as by using conveyor belt(s) (not shown). Fasteners 12 are supported by part holders 30, which are serially arranged about rotating disc 25, and described more specifically below. A photoelectric sensor feeder escapement can be used to time the release of each fastener 12 onto its associated part holder 30, given the speed of rotating disc 25. Support disc 25 transports fasteners 12 through a number of work stations, as now described.

During rotation of disc 25, the fasteners can first be heated in any manner well known to those of ordinary skill in the art. Preferably, an induction heating coil 27 is used to pre-heat the fasteners as they move on rotating on disc 25. Power to the induction coil is regulated to adjust the fastener temperature. This permits pre-heating of fasteners receiving liquid coatings, to facilitate drying. Alternatively, the fasteners can be pre-heated to different (e.g. higher) temperatures to melt and fuse powder coatings to the fasteners.

Figures 4, 4A:
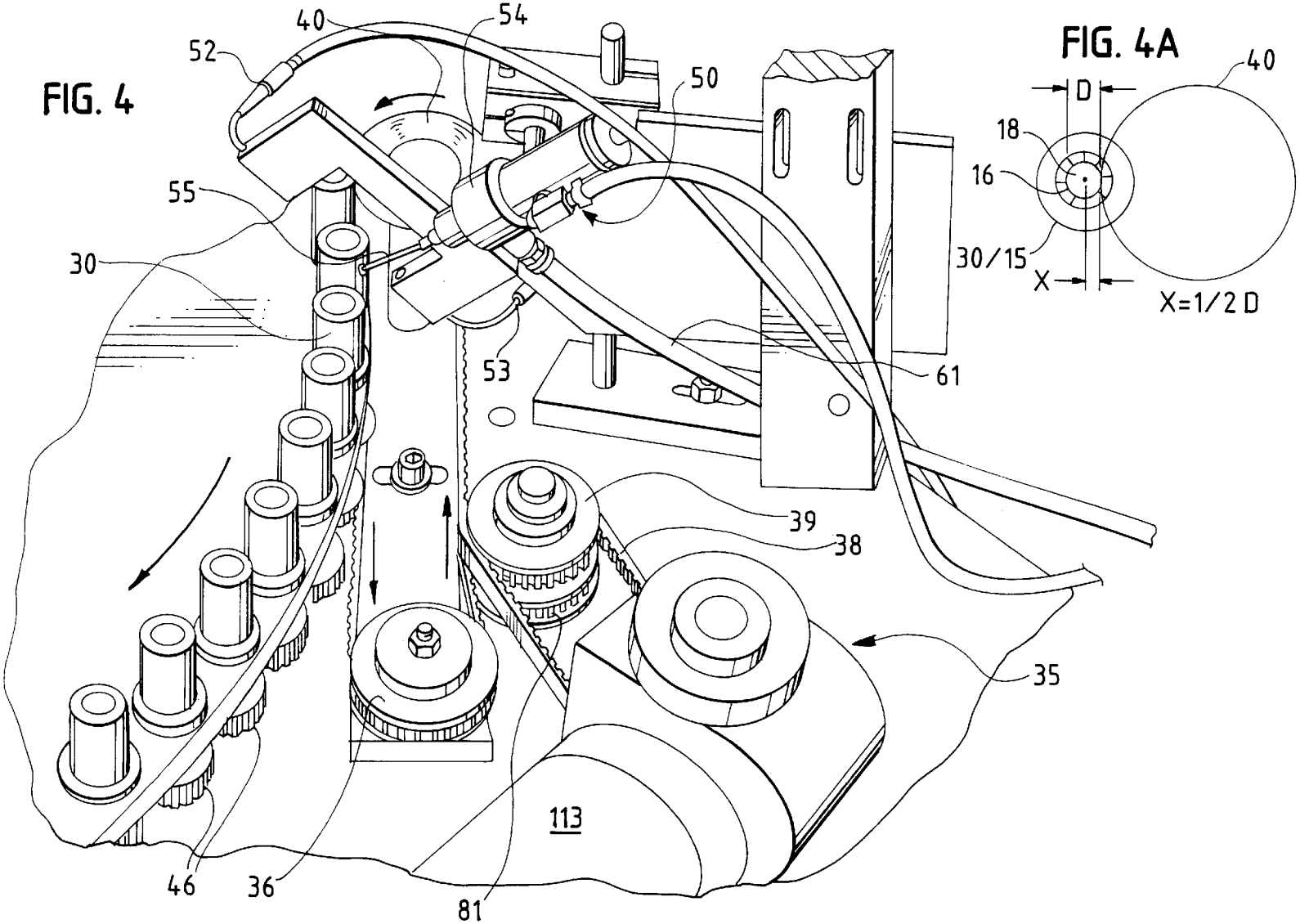
FIG. 4 is an enlarged view of the dispenser and associated controls of the apparatus.
FIG. 4A is a top view showing the preferred position of the centering disc relative to the parts holder and article to be coated.

Part holders 30 may maintain contact with fasteners 12 by magnetic or vacuum means, for example, or may support the fasteners using partial enclosures that are cup-shaped or other shapes. In the preferred embodiment shown in the drawings, part holder 30 is magnetized, and is adapted to rotate on its axis so that the associated fastener can be rotated at the coating application position to effect a 360° coating, as will now be described. Referring to FIG. 4, each magnetic part holder 30 includes at its base a timing sprocket 46 attached to holder 30 below disc 25. For this purpose, disc 25 includes a series of apertures, not shown, through which holders 30 are inserted.

Part holders 30 periodically engage a magnet rotation mechanism, designated generally as 35. Magnet rotation mechanism 35 includes a timing belt 31 wrapped around gears 36 (only one shown). Timing belt 31 periodically meshes with timing sprockets 46 to rotate part holders 30. Timing belt 31 is engaged by lower timing gear 81. Lower timing gear 81 turns with upper timing gear 39 and associated timing belt 38, which is driven by a variable speed, magnet rotating motor 113, so that the rotational speed of the fastener can be controlled. This allows the fastener to be coated about its entire 360° periphery or, alternatively, any selected amount of coating coverage less than its entire 360° periphery.

Referring to FIGS. 4, 4A and 5, centering disc 40 rotates in the direction of its associated arrow and is used to contact the threaded shank of the moving fastener and center it on part holder 30, to ensure a 360° (or some desired lesser coverage) is uniformly applied to the head/shank junction. Centering is required to eliminate fastener wobble during rotation so that a uniform coating is applied. Centering disc 40 may be driven by the timing belts or by contact with the rotating fastener. Centering disc 40 rotates in a direction counter to the rotation of disc 25; thus, relative to a point situated between the edges of rotating fastener 12 and centering disc 40, those edges are moving in the same direction. Centering disc 40 is strategically located with respect to the threads of fasteners 12 so that the fastener is centered when it loses contact with disc 40. Referring to FIG. 4A, the position of centering disc 40 is adjustable radially inward or radially outward relative to the center of disc 25, in accordance with the diameter of the fastener to be coated. Preferably, the edge of disc 40 that is closest to the part holders is always located a distance from the center of the closest part holder, "X", which is equal to one-half the diameter "D" of the fastener at its threaded shank, as shown in FIG. 4A.

After fastener centering, and during the simultaneous rotation of the fasteners by rotating disc 25 and rotating part holders 30, a coating is applied to the fasteners at a dispensing station situated adjacent a downstream, edge portion of disc 25. Referring to FIG. 4, a liquid coating is preferably dispensed through a dispenser nozzle 55 which includes a hypodermic-type hollow tube, onto the rotating fastener, using dispenser 50. Dispenser 50 is, most preferably, an EFD 1500XL dispenser or an EFD Valvemate Dispenser 7000 with an EFD valve 54 and a microprocessor time control, available from EFD, Inc. of East Providence, R.I. The coating material is supplied to dispenser 50 through chemical supply tube 61, which is connected to chemical reservoir 63 (FIG. 1).

One or more vacuum collectors (not shown) can also be provided at suitable locations to collect overspray from a powder application.

Figure 9:
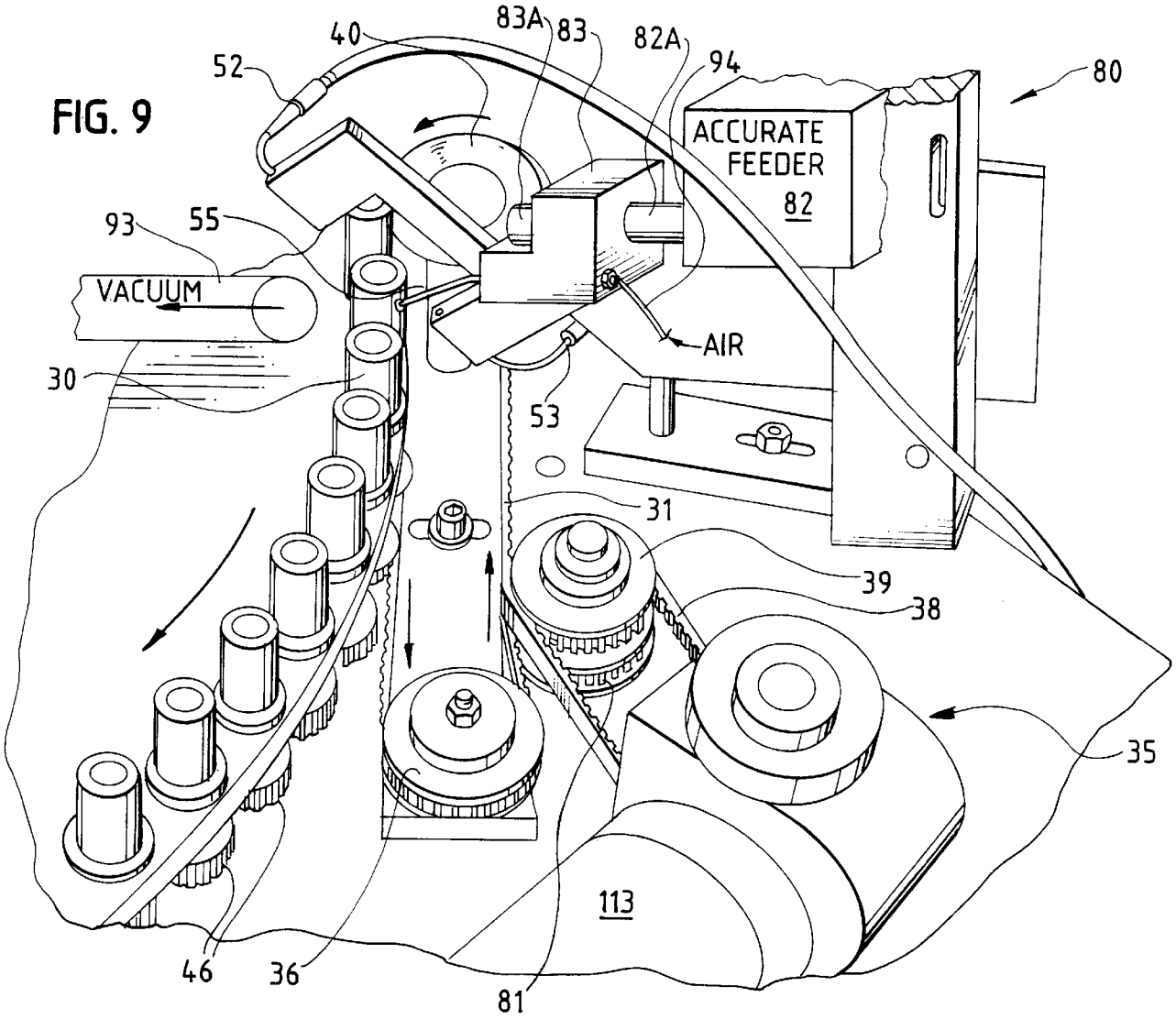
FIG. 9 is a view similar to FIG. 4 of an alternative embodiment including a powder dispensing system.
Figure 10:
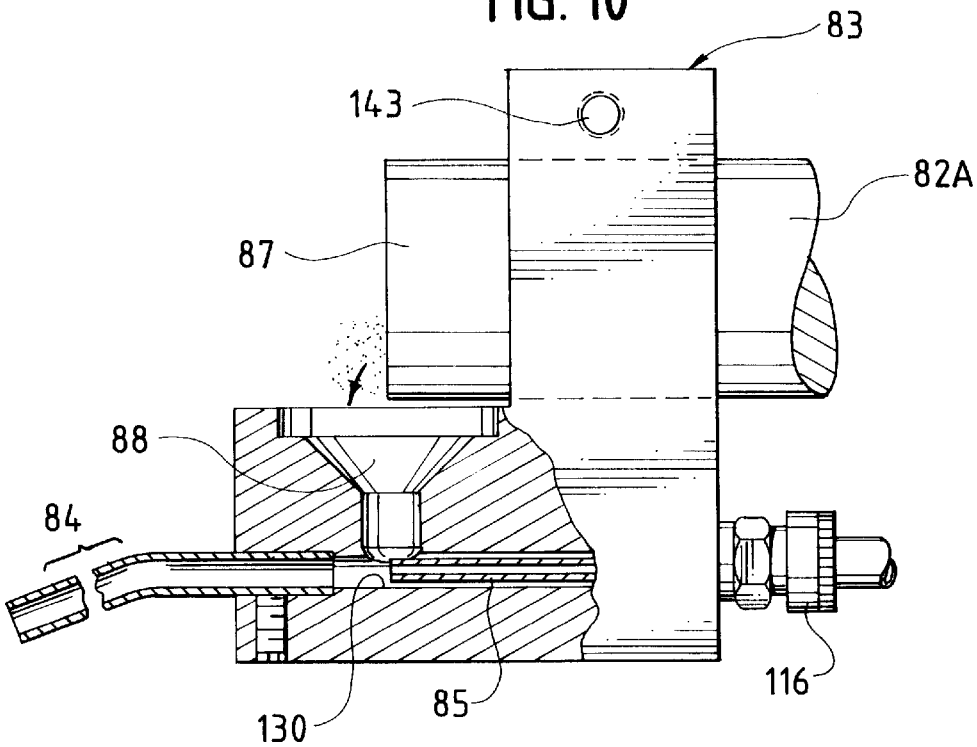
FIG. 10 is a side view, in partial cross-section, of one preferred embodiment of the powder dispensing system.
Figure 11:
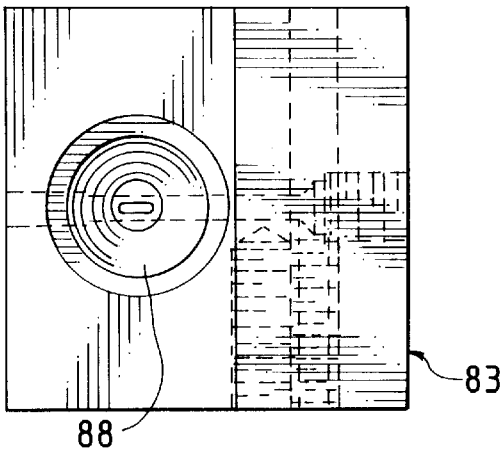
FIGS. 11, 12, and 13 are top, side and front views, respectively, of a portion of the powder dispensing system of the preferred embodiment.
Figure 12:
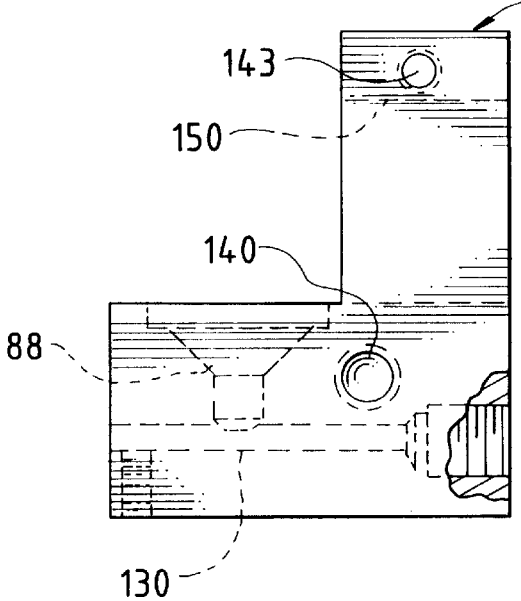
Figure 13:
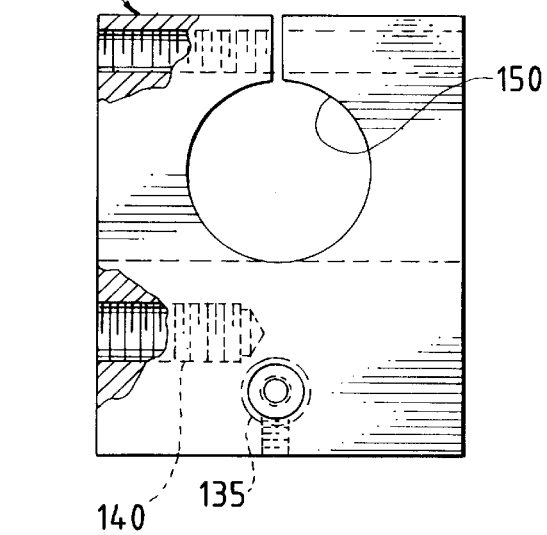

Alternatively, the liquid dispensing system may be replaced by a powder dispensing system, such as disclosed in U.S. Pat. No. 5,362,327, hereby incorporated by reference herein. In the preferred embodiment, the powder dispensing system is of the type shown in FIGS. 9–16. As shown in FIGS. 9–10, powder applicator 80 has replaced liquid dispenser 50, and includes powder feeder 82 and spray head 83. Powder feeder 82 has an outlet tube 82A which passes through aperture 150 located within an upper portion of spray head 83; outlet tube 82A terminates in a discharge nozzle 87. Feeder 82 is preferably an AccuRate® volumetric powder metering unit, available from Schenck AccuRate® of White Water, Wis., to provide a constant, regulated powder flow rate. As shown, powder supplied at a predetermined rate from feeder 82 drops from discharge nozzle 87 and into divider 88, whose function is discussed below. Spray head 83 includes spray nozzle 84, air jet tube 85 (located within passageway 130, as shown in FIG. 12) and air jet fitting 116 (which fits within pipe tap 135, as shown in FIG. 13). The method of rotating the article to be coated and the sensing system are similar to that disclosed with reference to the liquid dispensing system.

Still referring to the powder dispensing system shown in FIGS. 9–16, when a part is sensed to be in the proper location, a signal is given to activate a timer, a spray head vibrator, and the jet air supply (each of which is not shown), and the part is sprayed. The timer controls the time during which spraying occurs by periodically deactivating the jet air supply and the vibrator. The timer resets for each part. The spray cycle is adjusted to the rotation rate of supporting disc 25; thus, for example, the spray cycle time is reduced as the disc rotation rate is increased. The rate of individual part rotation is also adjustable based on the rotation rate of supporting disc 25. Referring to FIG. 12, tapped hole 140 is used for mounting the vibrator.

AccuRate feeder 82 activates when the first part is sensed and continuously provides powder until the last part is sprayed. Feeder 82 automatically shuts down, in a timed, predetermined fashion, following passage of the last part.

Figure 14:
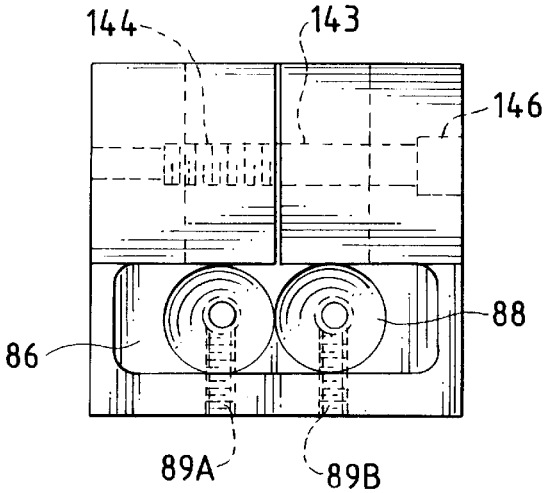
FIGS. 14, 15, and 16 are top, side and front views, respectively, of a second preferred embodiment of the powder dispensing system, employing multiple spray nozzles.
Figure 15:
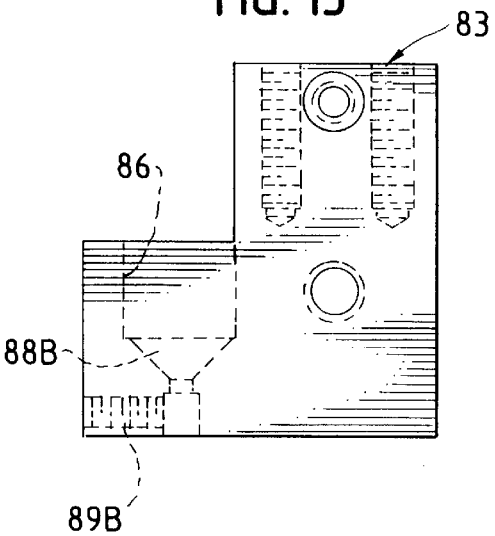
Figure 16:
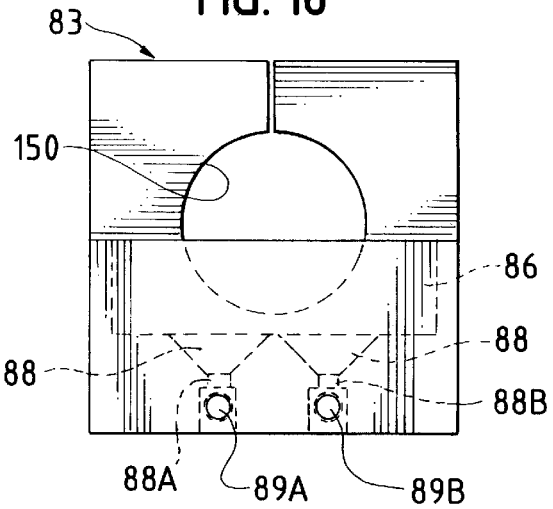

In one preferred embodiment, shown in FIGS. 14–16, parts may be sprayed with multiple spray nozzles. Flow dividers 88 are attached to discharge end 87 of feeder 82 for this purpose. Each of the respective outputs 88A, 889 of flow dividers 88 is directed to its own spray head 89A, 89B. Spray heads 89A, 89B are preferably separated by the same distance "X" that separates the parts on supporting disc 25, or some multiple of this distance (e.g., 2X, 3X, etc.), permitting each nozzle to spray a part simultaneously. By further subdividing the flow divider, more spray nozzles may be used, if necessary. Referring to FIG. 14, tapped hole 143 accommodates screw 144 which is used to clamp discharge nozzle 87 to outlet tube 82A.

The coating material, whether powder-based or liquid-based, is dispensed in timed relation with the movement of the fasteners. For this purpose, photoelectric sensors 52 and 53 sense fastener position and signal dispenser 50 to begin dispensing; alternatively, proximity switches could be used for this purpose. Using the time controls of dispenser 50, the start and extent of the coating operation can therefore be controlled.

Prior to collection in a bin, tub or other suitable collection location (not shown), fasteners with liquid coatings may require drying. To accelerate drying the fasteners are preferably pre-heated, as discussed above, and then post-heated in an infra-red, forced air oven 70. A conveyor (not shown) is provided within oven 70 for conveying the coated fasteners, head down, through the oven. For fasteners coated with melted powder, the infra-red heaters of oven 70 are turned off, and the conveying time through the oven can be used to cool the fasteners prior to stacking them in a cooling tub or other convenient location.

Referring to FIG. 5, after the coating application the fasteners can be cammed off the magnets by stainless steel rod 95. Low air flow through tube 90 and nozzle 92 assists in removing coated fasteners 12 off of part holders 30 and down downtrack 96. The fasteners can then be conveyed by downtrack 96 to oven 70.

Referring back to FIG. 1, associated components of apparatus 10 of the present invention will now be described. Thus, apparatus 10 includes an air control panel 110 for controlling the force of the low pressurized air supplied through tube 90 and nozzle 92, and the force of high pressurized air to EFD unit 120. An EFD chemical controller 120 communicates with EFD valve 54 on dispenser 50 through dispenser tube 127 to control the flow of the coating material. Electrical power to apparatus 10 is controlled by start/stop box 115. Disc speed controller 123 includes a motor for controlling and powering the movement of disc 25. Magnet motor controller 117 includes dials permitting selective control over the speed of variable motor 113. Induction generator 121 supplies power to the induction coils and is used to pre-heat the articles. Chemical reservoir stirrer motor 119 drives the stirrer within chemical reservoir 63. Counter 126 positioned on chemical controller 120, in conjunction with an associated sensor and fibre optic pair 126A (FIG. 5), maintains a count over the fasteners that are coated.

Figure 8:
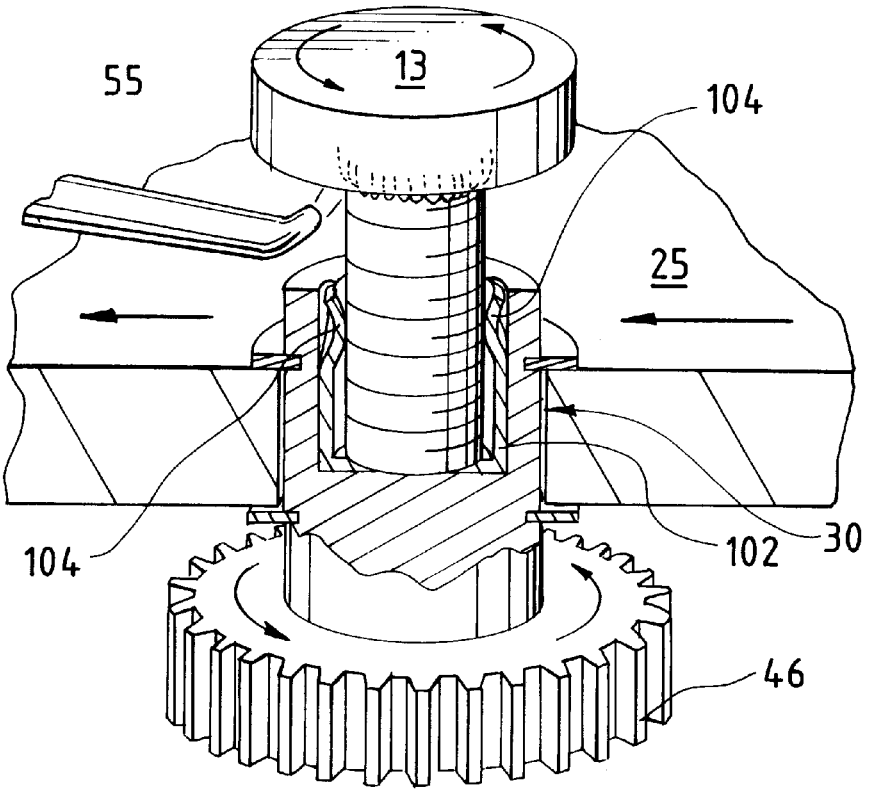
FIG. 8 is a side view, in partial cross-section, of an alternative embodiment of the parts holder of the present invention.

The present invention encompasses other embodiments than those shown in the drawings. For example, part holders 30 can form an enclosure that permits the threaded fasteners to be positioned shank-side down instead of head down, as shown in FIG. 8; with this embodiment, coating spray from dispenser nozzle 55 is preferably directed upward toward knurls 16. Bore 102 locates fastener 12, and has a depth which seats the fasteners while exposing knurls 16 above part holder 30. Leaf springs 104 positioned on opposing sides of bore 102 can be used to maintain fastener 12 in position to eliminate undesirable movement of the fastener during fastener rotation or during the coating application. In this embodiment, a centering disc need not be used since bore 102 is sized to properly position the fasteners. Again, timing sprocket 46 is connected to the base of part holder 30, and the holder is rotated in the same manner described above.

The present invention can be used to coat portions of parts or articles other than externally threaded fasteners. For example, threaded nuts or even irregular stampings can be coated using part holders with various accommodating geometrical shapes. However, it is currently believed that the specific embodiment disclosed in the drawings is used to best advantage when applying a coating to the head-shank junction of externally threaded fasteners.

Various types of powder and liquid coatings can be used by the present invention, including various sealant-type coatings such as a liquid sealant known as PRECOTE 5® (a registered trademark of omniTechnik Mikroverkapselungs-GmbH, a German corporation, and available from the current assignee of this application), or a powder sealant known as NYSEAL® (a registered trademark of the current assignee and also available from the current assignee). To use a PRECOTE 5® coating, pre-heat and oven temperatures of about 150° F. may be used; for a NYSEAL® coating, substantially higher temperatures (e.g., up to 400° F.) may be used.

Other powder or liquid coatings can be used for other purposes, such as for self-locking, masking, insulating or lubricating purposes. Thus, fluoropolymer compounds such as Teflon® (a registered trademark of DuPont), thermoplastic polyamide resins such as nylon, epoxy resins or other coating materials can be used by the present invention.

It will be understood that the invention may be embodied in other specific forms without departing from its spirit or central characteristics. The present examples and embodiments, therefore, are to be considered in all respects as illustrative and not restrictive, and the invention is not to be limited to the details given here.

We claim:

1. An apparatus for applying a liquid sealant coating to externally threaded articles having a head and a shank, the coating being applied to the junction of the head and the shank in an automated fashion to provide a seal between the threaded article and a workpiece, comprising:

a moving support for conveying the articles;

a plurality of part holders adapted to support and to hold the articles in a generally fixed position with a longitudinal axis of each article oriented vertically during article movement with the support; a dual drive system including the moving support for conveying the articles to be coated and a rotational device enabling each part holder to separately rotate each article generally about the part holder axis;

a heating station positioned adjacent the moving support for heating the articles to within a predetermined temperature range as the articles move with the support;

a sensor for sensing the position of the heated articles as they move with the support;

a reservoir for housing a pressurized supply of the liquid sealant coating; and at least one stationary dispenser in liquid communication with the reservoir for intermittently applying a substantially uniform and predetermined amount of the liquid sealant coating onto the head-shank junction of each article as the part holders and associated articles move with the support and rotate relative to the dispenser the at least one dispenser having a narrow tubular nozzle dimensioned to apply the sealant coating to only the head-shank junction of the articles, the intermittent coating application occurring in timed sequence with and selectively responsive to the support-induced movement and simultaneous rotation of the articles, to thereby permit coating coverage around the 360° circumference of the head-shank junction of each article.

2. The apparatus of claim 1, wherein the part holders have a magnetic attraction for the articles.

3. The apparatus of claim 1, wherein the moving support is a rotating disc, and the part holders and associated articles are located about the periphery of the disc.

4. The apparatus of claim 1, wherein the rotational device comprises a timing sprocket and variable speed motor for selectively controlling the speed of rotation of the part holders.

5. The apparatus of claim 1, further comprising a centering disc capable of rotation and positioned adjacent the moving support, the centering disc adapted to contact the moving articles and thereby generally center each article on its associated part holder, to minimize article movement relative to the associated part holder, thereby facilitating the application of a substantially uniform coating on the article at the head-shank junction.

6. The apparatus of claim 5, wherein the moving support is a rotating disc, and the rotating and centering discs rotate about their respective centers in opposite directions when viewed from a point located above the discs.

7. The apparatus of claim 1, wherein the heating station includes induction coils positioned adjacent the edge of moving support, the induction coils being shaped and located to permit the adjacent passage of the articles, while heating the articles to the predetermined temperature range.

8. The apparatus of claim 1, wherein the sensors are photoelectric sensors.

9. The apparatus of claim 1, further comprising an infrared forced-air oven for receiving the articles and baking them for a time period sufficient to substantially dry the coating.

10. The apparatus of claim 1, wherein the threaded articles have knurls formed at the head/shank junction which extend generally normal to the longitudinal direction of the shank.

11. An automated process for applying a liquid sealant coating to an externally threaded article having a head and a shank, the coating being applied to the junction of the head and the shank to provide a seal between the threaded article and a workpiece comprising the steps of:

locating a plurality of the articles on a moving support; providing a plurality of part holders each adapted to support and to hold an article in a generally fixed position with a longitudinal axis of each article oriented vertically during article movement with the support, providing a dual drive system including the moving support for conveying the articles to be coated and a rotational device enabling each part holder to separately rotate each article generally about the part holder axis;

continuously conveying the articles through a heating station using the moving support, wherein the articles are heated to within a predetermined temperature range;

sensing the position of the heated articles as they move with the support;

separately rotating each article generally about its axis using the part holders; and automatically dispersing, in an intermittent fashion, a predetermined amount of the liquid sealant coating from a pressurized supply by using a narrow, stationary tubular nozzle dimensioned so that the coating is only applied onto the head-shank junction of the articles as the part holders and associated articles move along the support and rotate relative to the nozzle the dispensing occurring in timed sequence with and selectively responsive to the movement of the articles with the support and their simultaneous rotation, to thereby permit coating coverage around the 360° circumference of the head-shank junction of each article.

12. The automated process of claim 11, further comprising the step of baking the articles for a time period sufficient to cause the liquid-based coating to dry and adhere to the fastener surface at the head-shank junction.

13. The automated process of claim 11 wherein the moving support includes a rotating disc.

14. The automated process of claim 11, further comprising the step of centering each article on its associated holder to facilitate the application of a substantially uniform coating on the fastener surface at the head-shank junction.

15. The automated process of claim 11, wherein the predetermined temperature range is about 150° F. for liquid-based sealant coatings.

16. The automated process of claim 11, wherein the articles are positioned head down on the part holders, and the part holders are magnetically attracted to the articles.

17. The automated process of claim 11, further comprising the step of discharging the coated fasteners from the moving support and off the magnetic surface by contacting them with a mechanical level and also using pressurized air directed against the fasteners.

18. An automated process for applying a reusable liquid sealant coating to an externally threaded article having a head and a shank, the coating being applied to the junction of the head and the shank to provide a seal between the threaded article and a workpiece, comprising the steps of:

providing a dual drive system including a moving support for conveying the article to be coated and a rotational device enabling the article to rotate generally about its longitudinal axis;

locating a plurality of the articles on the moving support; continuously conveying the articles through a heating station using the moving support;

sensing the position of the heated articles as they move with the support;

separately rotating each article generally about its axis;

automatically dispensing a predetermined amount of the liquid sealant from a pressurized supply by using a narrow tubular stationary nozzle dimensioned so that the coating is only applied onto the head-shank junction of the articles as the articles move along the support, the dispensing occurring during rotation of the articles generally about their own axis, and continuing for a predetermined period in timed sequence with the support-induced and rotational movements of the articles, to thereby permit coating coverage around the 360° circumference of the head-shank junction of each article; and heating the articles following the dispensing step for a time period sufficient to cause drying and adherence of the liquid-based coating to the fastener surface at the head-shank junction.

* * * * *